US009530528B2

(12) United States Patent
Andrews

(10) Patent No.: US 9,530,528 B2
(45) Date of Patent: Dec. 27, 2016

(54) X-RAY TUBE APERTURE HAVING EXPANSION JOINTS

(75) Inventor: Gregory C. Andrews, Draper, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 477 days.

(21) Appl. No.: 13/328,861

(22) Filed: Dec. 16, 2011

(65) Prior Publication Data

US 2013/0156161 A1 Jun. 20, 2013

(51) Int. Cl.

| | |
|---|---|
| ***H01J 23/00*** | (2006.01) |
| ***G21F 3/00*** | (2006.01) |
| ***H01J 35/16*** | (2006.01) |

(52) U.S. Cl.

CPC ..... *G21F 3/00* (2013.01); *H01J 35/16* (2013.01); *H01J 2235/168* (2013.01)

(58) Field of Classification Search

CPC ..... H01J 2235/165–2235/168; H01J 35/16

See application file for complete search history.

(56) References Cited

U.S. PATENT DOCUMENTS

| | | | | |
|---|---|---|---|---|
| 6,075,839 | A | 6/2000 | Treseder | |
| 6,115,454 | A | 9/2000 | Andrews et al. | |
| 6,215,852 | B1 | 4/2001 | Rogers et al. | |
| 6,519,317 | B2 | 2/2003 | Richardson et al. | |
| 6,519,318 | B1 | 2/2003 | Andrews | |
| 6,619,318 | B2 | 9/2003 | Dalhart et al. | |
| 7,289,603 | B2 | 10/2007 | Andrews et al. | |
| 8,000,450 | B2 | 8/2011 | Andrews | |
| 2009/0080617 | A1* | 3/2009 | Andrews | 378/142 |
| 2010/0278309 | A1* | 11/2010 | Hauttmann | 378/142 |

* cited by examiner

*Primary Examiner* — David J Makiya
*Assistant Examiner* — Dani Fox
(74) *Attorney, Agent, or Firm* — Maschoff Brennan

(57) ABSTRACT

An x-ray tube electron shield is disclosed for interposition between an electron emitter and an anode configured to receive the emitted electrons. The electron shield includes expansion joints to accommodate thermal expansion.

19 Claims, 4 Drawing Sheets

X-RAY TUBE APERTURE HAVING EXPANSION JOINTS

BACKGROUND

1. Technology Field

Embodiments of the present invention generally relate to x-ray generating devices. More specifically, example embodiments relate to an electron shield configured to intercept and absorb backscattered electrons and having a construction that reduces heat-related damage.

2. The Related Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, and then impinged upon a material of a particular composition. This process typically takes place within an x-ray tube located in the x-ray generating device. The x-ray tube generally comprises a vacuum enclosure, a cathode, and an anode. The cathode, having a filament for emitting electrons, is disposed within the vacuum enclosure, as is the anode that is oriented to receive the electrons emitted by the cathode.

The vacuum enclosure may be composed of metal such as copper, glass, ceramic, or a combination thereof, and is typically disposed within an outer housing. The entire outer housing is typically covered with a shielding layer (composed of, for example, lead or similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating it to an external heat exchanger via a pump and fluid conduits.

In operation, an electric current is supplied to the cathode filament, causing it to emit a stream of electrons by thermionic emission. In anode end grounded (AEG) x-ray tubes, a high negative electric potential is placed on the cathode while the anode is electrically grounded. This causes the electron stream to gain kinetic energy and accelerate toward a target surface disposed on the anode. Upon impingement at the target surface, some of the resulting kinetic energy is converted to electromagnetic radiation of very high frequency, i.e., x-rays.

The characteristics of the x-rays produced depend in part on the type of material used to form the anode target surface. Target surface materials having high atomic numbers ("Z numbers"), such as tungsten or TZM (an alloy of titanium, zirconium, and molybdenum) are typically employed. The resulting x-rays can be collimated so that they exit the x-ray device through predetermined regions of the vacuum enclosure and outer housing for entry into the x-ray subject, such as a medical patient.

One challenge encountered with the operation of x-ray tubes relates to backscattered electrons, i.e., electrons that rebound from the target surface along unintended paths in the vacuum enclosure. Depending on the environment, upwards of thirty percent of the electrons traveling from the cathode to the anode hit and bounce from the point of impingement. These rebounding, backscattered electrons can impact areas of the x-ray tube where such electron impact is not desired. These impacts result in the generation of excess heat that can damage the impacted component.

To minimize the effects of backscattered electrons, a backscatter electron collection device, sometimes referred to as an "aperture" or "aperture shield," can be included in x-ray tubes. Such a device can be interposed between the electron emitting filament of the cathode and the anode target surface. The device can include an aperture through which the primary electrons can pass from the filament toward impingement on the target surface. In addition, the collection device is configured to intercept most of the electrons that subsequently rebound from the target. By collecting at least a portion of the backscattered electrons, the collection device acts as a shield and prevents their impingement on less desirable portions of the x-ray tube.

Although this collection of backscattered electrons at the electron collection device protects other portions of the x-ray tube, it nonetheless can give rise to problems in the collection device itself. In particular, the energy associated with the backscattered electrons heats the aperture causing it to expand. At a certain input power level the amount of expansion exceeds the aperture material's yield point causing plastic deformation due to thermal stresses. Repeated heating cycles associated with repeated x-ray exposures leads to aperture failure due to cracking and delamination. In addition, repeated contraction and expansion increases the number and rate at which particles are detached from the electron shield, known as "particulation rates," which results in tube arcing.

Failure of the electron shield in the manner described above is detrimental to tube performance. For example, the electron shield might define a portion of the vacuum envelope in which critical tube components, such as the cathode and anode, are housed. Upon failure of the electron shield, the vacuum can be compromised thereby rendering the x-ray tube useless, requiring its replacement often at significant cost. At a minimum the thermal-induced damage reduces tube operating life.

Attempts to completely solve some of the above problems have not been entirely successful and/or desirable. For example, the use of expensive copper alloys such as Glidcop™ have been used to reduce plastic deformation at the aperture. However, such materials are expensive and typically cannot be operated at higher operating powers, e.g., lower than approximately 72 kW. Other solutions might involve providing an electron shield with a larger diameter aperture. However, this approach reduces the overall number of backscattered electrons that are captured, allowing a greater percentage to rebound back to the surface of the anode and thereby affecting image quality.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Briefly summarized, embodiments of the present invention are directed to an electron shield for use in an x-ray tube and configured for interposition between an electron emitter and an anode configured to receive the emitted electrons. In example embodiments, the electron shield includes an electron collection surface, which is configured so that at least a portion of the electrons backscattered from the anode strike the collection surface instead of other areas of the x-ray tube. In addition, the electron shield is configured so as to reduce damage that might otherwise result from the high temperatures caused by the backscattered electrons striking the collection surface. This reduction in thermal stress reduces the incidence of failure in the electron shield and increases the overall operating life of the x-ray tube.

In one example embodiment the electron shield includes a body having an aperture formed through the center of the electron collection surface that defines a pathway for electrons to travel from the cathode to the anode surface. Electrons that rebound from the anode are collected at the electron collection surface and the resultant kinetic energy is released primarily in the form of heat, thereby causing the shield, particularly in the region of the collection surface adjacent to the aperture where more rebound electrons strike, to increase in temperature. During normal operation of the x-ray tube, this repeated heating of the electron shield results in thermal expansion and contraction. In an example embodiment, the shield is provided with one or more expansion joints positioned so as to minimize these "hoop" stresses by permitting the aperture to "expand" into the joints, thereby reducing damage to the shield that might otherwise occur.

In example embodiments, the expansion joints are provided in the form of one or more openings or gaps provided in electron shield so as to provide areas into which the aperture can expand when heated. These joints allow for elastic expansion and contraction in the aperture and/or the collection surface so as to reduce maximum mechanical stresses and reducing, for example, cracking and delamination at the collection surface. The electron shield is therefore better equipped able to withstand thermal stresses resulting in longer component life.

In one embodiment, the expansion joints are provided as a plurality of slots formed in the surface of the collection surface. While different orientations and arrangements might be used, in a preferred embodiment the slots are disposed so as to extend radially outward from the central aperture. The slots might have different widths and/or lengths with respect to one another, or may all have substantially the same width and length, depending on the thermal response that may be desired. In one implementation, one or more of the slots extend completely through the body of the electron shield and are oriented at a slight angle offset with respect to the direction of electron travel so as to prevent backscattered electrons from passing completely through the slots without impinging upon the electron shield. The angle may be constant along the length of the slot, or may be varied along its length.

While the invention does not require that the electron shield and the collection surface have any specific shape or configuration, in certain embodiments the electron shield includes a body that defines a generally bowl-shaped or concave/convex electron collection surface with an aperture allowing for passage of electrons from the cathode to the anode surface. The shaped collection surface can be oriented so as to maximize the number of backscattered electrons that are captured. Depending on the implementation and tube configuration, the collection surface might substantially face the anode. In other implementations it might face the cathode. Of course, other configurations might be used. For example, the collection surface may be formed as a cylindrical surface coextensive with the aperture. Alternatively it might be formed as a cylinder with a non-uniform diameter along its length, e.g., narrowed at the aperture and enlarged in a central region.

The body of the electron shield might be configured as a single integral piece of material. In other embodiments it is formed from multiple pieces and/or with different sections formed from different materials. For example, one example embodiment utilizes a bimetallic configuration. Here, the region of the electron shield that is impacted by relatively more backscattered electrons due to proximity to the anode target surface, such as a portion or the entire collection surface is comprised of a refractory material. Expansion joints such as slots are formed in the collection surface and extend from the aperture radially outward. The remainder of the body of the shield is composed of a metal having high thermal conductivity, such as copper. Use of the refractory metal, which is more heat resistant, increases the maximum input power capabilities by increasing the maximum operating temperature.

In some embodiments, the electron shield includes a cooling system implemented, for example, with at least one fluid passageway formed within the body of the electron shield structure. The fluid passageway is configured to circulate a coolant, for example, from a coolant reservoir of the x-ray tube, so as to absorb and remove heat generated in the shield structure.

The cooling system can also include a plurality of extended surfaces, or cooling fins, that are affixed to the outer surface of the body of the shield structure and/or within the fluid passageway. The extended surfaces enhance the transfer of heat from the shield to coolant disposed within, for example, the x-ray tube housing in which the evacuated enclosure is disposed.

The inventive concepts provide a number of surprising advantages and benefits. For example, the lower stresses enabled by the expansion joints enable the use of organic-based heat transfer fluids as a shield coolant in lieu of water-based heat transfer coolants. In addition, the design allows for a small diameter aperture opening, resulting in the capture of a greater percentage of rebound electrons. In addition, lower cost materials can be used then what was previously required to maintain acceptable stress levels. The decreased thermal stresses that result from the design also increases the maximum heat loading capacity of both the electron shield and the tube. The design also increases the electron shield operating life for a given maximum power input. Moreover, it greatly reduces x-ray tube electrical arcs due to the reduction in aperture particles.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features will be set forth in the description which follows, and in part will be obvious from the description, or may be learned by the practice of the teachings herein. Features of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1-4 depict various features of example embodiments. In general, embodiments are generally directed to an electron shield for interposition between an electron emitter and an anode configured to receive the emitted electrons, such as in an x-ray tube. The primary function of the shield is to "collect" electrons backscattered from the anode. Advantageously, the electron shield is configured to withstand the elevated temperatures produced by backscattered electrons and incident on selected portions of the electron shield and resultant thermal stresses that occur. This in turn equates to a reduced incidence of failure in the electron shield and in the vacuum envelope, or evacuated enclosure, that it partially defines in the x-ray tube. In particular, the shield is provided with one or more expansion joints positioned so as to minimize these thermal stresses by permitting the aperture to "expand" into the joints, thereby reducing damage to the shield that might otherwise occur.

Figure 1:
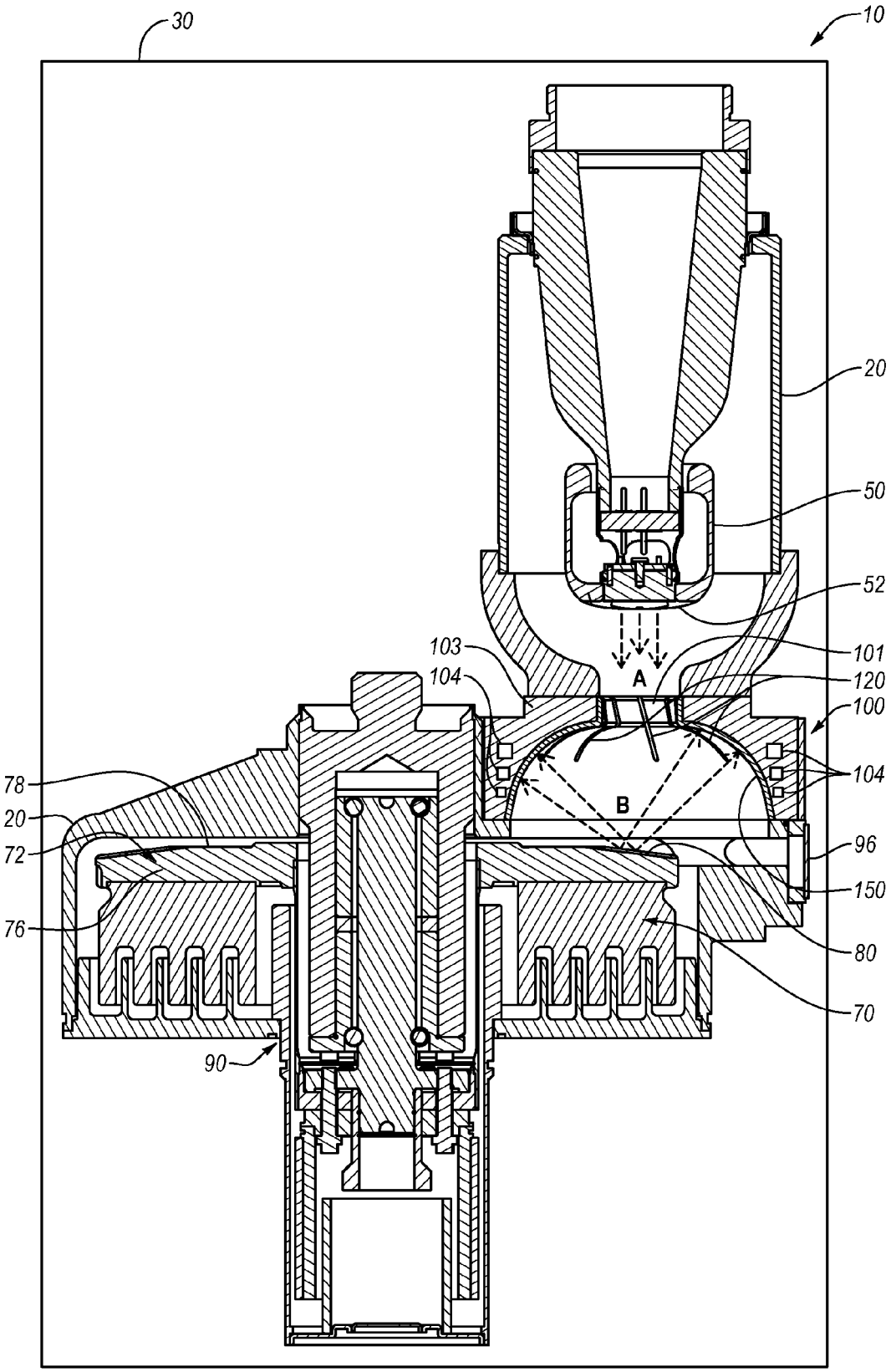
FIG. 1 is a cross sectional view of an x-ray tube that serves as one example environment in which embodiments of the present invention can be practiced.

Reference is first made to FIG. 1, which depicts one possible environment wherein embodiments can be practiced. Particularly, FIG. 1 shows an x-ray tube environment, designated generally at 10, which serves as one example of an x-ray generating device. The x-ray tube 10 generally includes an evacuated enclosure 20, disposed within an outer housing 30. The evacuated enclosure 20 defines and provides the necessary vacuum envelope for housing the cathode and anode assemblies 50, 70 and other critical components of the tube 10 while providing the shielding and cooling necessary for proper x-ray tube operation. Typically, the housing 30 contains a coolant that is circulated via cooling system pump (not shown) to remove heat from the surface of the evacuated enclosure. The evacuated enclosure 20 in one embodiment further includes shielding (not shown) that is positioned so as to prevent unintended x-ray emission from the tube 10 during operation. Note that, in other embodiments, the x-ray shielding is not included with the evacuated enclosure, but rather is joined to the outer housing that envelops the evacuated enclosure. In yet other embodiments, the x-ray shielding may be included neither with the evacuated enclosure nor the outer housing, but in another predetermined location.

In greater detail, the cathode assembly 50 is responsible for supplying a stream of electrons for producing x-rays, as previously described. The cathode assembly 50 includes a cathode head 52 that houses an electron source (not shown), such as a filament, for the emission of electrons during tube operation. The electron source is connected to an electrical power source (not shown) to enable the production of relatively high-energy electrons.

Generally responsible for receiving the electrons produced by the electron source and converting them into x-radiation ("x-rays") to be emitted from the evacuated enclosure 20, the anode assembly 70 includes an anode 72 and an anode support assembly 74. While any one of a different number of configurations could be used, the example embodiment includes an anode 72 having a target surface 78 and a substrate 76. The target 72 is composed of Tungsten or a similar alloy. A focal track 80, typically formed along an angled outer periphery of the target surface 78, is positioned such that the stream of electrons emitted by the filament impinge on the focal track and produce x-rays (not shown) for emission from the evacuated enclosure 20 via an x-ray transmissive window 96.

In greater detail, the anode 72/substrate 76 is rotatably supported by the anode support assembly 74, which generally includes a rotor and stator assembly 90. The stator is circumferentially disposed about a portion of the rotor assembly to provide the needed rotation of the anode 72 during tube operation in a manner that is well known. Again, it should be appreciated that embodiments of the present invention can be practiced with anode assemblies having configurations that differ from that described herein. For example, embodiments of the electron shield discussed herein might have applicability in connection with a stationary anode implementation.

As the production of x-rays described herein is relatively inefficient and yields large quantities of heat, the anode assembly 70 is configured to allow for heat removal during tube operation such as, for instance, circulation of a cooling fluid through designated structures of the anode assembly. Notwithstanding the above details, however, the structure and configuration of the anode assembly can vary from what is described herein while still residing within the claims of the present invention.

The example electron shield, generally designated at 100, is positioned between the cathode head 52 and the anode 72. The electron shield includes a body 103 that defines an aperture 101 to allow the electrons (schematically represented as dotted lines denoted at 'A') emitted from the filament assembly to pass through the shield for impingement on the anode focal track 80. The electron shield 100 is further configured to intercept electrons that rebound, or "backscatter," from the anode focal track 80 during tube operation. Examples of such "backscatter" or "rebound" electrons are represented as dotted lines denoted at 'B'. Interception of the backscattered electrons by the electron shield 100 preferably occurs along a collection surface 150 portion of the electron shield 100, thereby preventing the electrons from impacting and possibly damaging other tube components.

The collection surface 150 might have any one of a number of configurations and shapes that achieve the objective of collecting backscattered electrons as the rebound from the surface of the anode. In the embodiment illustrated in FIG. 1 the collection surface is formed with a generally bowl or concave shape. In this illustrated example the collection surface 150 is oriented to generally face the anode. As will be seen below, in other implementations the collection surface might face the cathode instead. Of course, other configurations might be used. For example, the collection surface may be formed as a substantially cylindrical passageway interposed between the anode and cathode. Alternatively it might be formed as a cylinder with a non-uniform diameter along its length. Non-limiting examples of different "collection surface" configurations are shown, for example, in U.S. Pat. No. 7,289,603 entitled "Shield Structure and Focal Spot Control Assembly for X-ray Device," the contents of which are incorporated herein by reference in its entirety.

In example embodiments, the electron shield 100 includes one or more expansion joints that are configured to accommodate thermal expansion within the collection surface 150 and aperture 101 and are preferably provided in the form of one or more openings or gaps provided in electron shield so as to provide areas into which the aperture can expand when heated. Again, these joints allow for elastic expansion and contraction in the aperture and/or the collection surface so as to reduce maximum mechanical stresses and reducing, for example, cracking and delamination at the collection surface.

In the embodiment illustrated in FIG. 1, the expansion joints are provided as a plurality of slots, denoted at 120, formed in the collection surface and through the body 103 of the shield 100. While different orientations and arrangements might be used, in a preferred embodiment the slots are disposed as illustrated so as to extend radially outward from the central aperture 101. The slots might have different widths and/or lengths with respect to one another. In the illustrated embodiment each of the slots has substantially the same width and length, depending on the thermal response that may be desired. As is shown in the example embodiment, the slots extend completely through the body 103. In addition, in preferred embodiments the slots are oriented at a slight angle offset with respect to the direction of electron travel so as to prevent backscattered electrons from passing completely through the slots. The illustrated slots are one non-limiting example of structure corresponding to means for accommodating thermal expansion with regions of the shield, including the collection surface, the aperture and/or other regions of the shield body.

Figure 2:
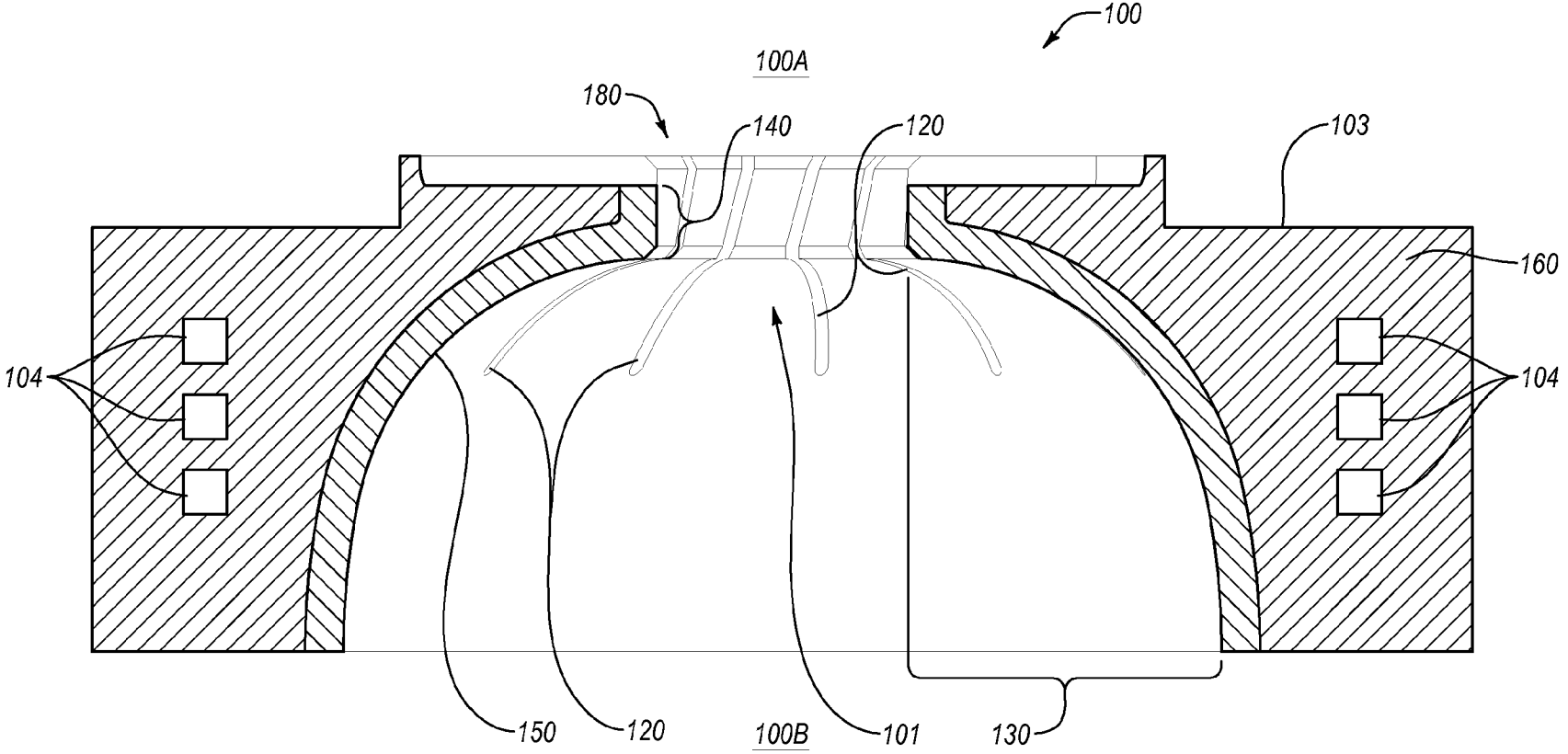
FIG. 2 is a cross sectional view of an example electron shield.

Reference is now made to FIG. 2 which shows additional details of an example electron shield implementation. As suggested, the electron shield 100 is configured to withstand the extreme temperatures imparted thereto as the result of its absorption of backscattered electrons. Specifically, the example electron shield 100 includes a body that defines the aperture 101. In addition, this particular example is implemented such that those regions of the body that are subject to relatively more electron impacts from backscattering are relatively more suited to withstand the resultant thermal stress.

In detail, the embodiment of FIG. 2 shows that the electron shield 100 includes a body 103 having a first end 100A and second end 100B, respectively the top and bottom ends. As seen in FIG. 1, the first and second ends 100A, 100B are configured to operably mate with corresponding portions of the x-ray tube 10 to define, for example, a portion of the evacuated enclosure 20. Of course, other approaches for disposing the shield 100 between the cathode assembly and the anode assembly might be utilized. Additional non-limiting examples are shown in U.S. Pat. No. 6,519,318 "Large surface area x-ray tube shield structure," the entire contents of which are incorporated herein by reference.

As mentioned, the body of the illustrated electron shield 100 defines the aperture 101 extending between the first and seconds ends 100A, 100B. As previously discussed, the electron shield 100 is interposed between the electron source of the x-ray tube 10 and the anode 72 such that electrons emitted by the electron source pass through the aperture 101 en route to impingement on the focal track 80 of the anode target surface 78.

In the example of FIG. 2, the electron shield 100 defines an electron collection surface 150 that is fashioned in the shape of a concave or bowl 130 configuration and a throat portion 140. Note that the body might be compositely formed of a single piece or could be formed of more than one piece.

In the illustrated embodiment, the electron collection surface 150 and the throat are composed of a refractory material, such as molybdenum, tungsten, or niobium, or suitable allows such as TZM (an alloy composed of tungsten, zirconium, and molybdenum). A refractory material such as TZM is mechanically stable at high operating temperatures, which further prevents cracking or failure of the electron shield 100. TZM also exhibits a high yield strength, which enables the electron shield structure to be made relatively thinner while still maintaining suitable shield strength. For instance, GLIDCOP® has a yield strength of about 45 ksi, while standard refractory materials have a yield strength of about 150 ksi. A thinner electron shield structure improves heat conductivity from the electron shield 100 to heat removing components of the x-ray tube 10, such as cooling fluid circulated about the electron shield 100 and/or over an outer surface of the shield. This also mitigates the fact that refractory materials have a lower thermal conductivity compared to OFHC copper or GLIDCOP®.

In combination with the refractory metal portion in region 130, an inner portion 160 of the upper electron shield is composed of a relatively higher thermally conductive material, such as oxygen-free high conductivity copper ("OFHC"), which exhibits excellent heat conduction capability. Other thermally conductive materials may also be employed. Examples and additional details of the use of a refractory metal in the electron shield can be found in U.S. Pat. No. 8,000,450 entitled "Aperture Shield Incorporating Refractory Materials," the contents of which are incorporated herein by reference in its entirety.

It is appreciated that, in addition to refractory material, other materials may be suited for use in the electron shield 100. Preferred characteristics of the material include thermal stability at the high temperatures encountered in the electron shield, relatively high thermal conductivity, acceptable mechanical strength, and a coefficient of thermal expansion that is sufficiently similar to the other materials from which the electron shield is composed—such as OFHC and GLIDCOP® in the present embodiment. Thus, it should be appreciated that composition of the electron shield should not be limited only to what is explicitly described herein. Also, depending on the particular thermal requirements, the entire shield might be comprised of a single material, such as copper.

In one example embodiment, the inner portion 160 being near the exterior of the electron shield 100 has defined therein a plurality of fluid channels 104 for the conduction of heat from the electron shield 100. Absorption by the electron shield 100 of the majority of backscattered electrons during tube operation results in large quantities of heat being imparted to the electron shield 100. The fluid channels 104_annularly surround exterior portions of the electron shield 100 including the bowl 130 and throat 140. The fluid passageways 104 are employed to contain a coolant that can be circulated through the passageways to remove this heat from the electron shield 100. Again, the specific implementation of the fluid passageways is not limited to what is shown. The number, relative sizes, positioning within the shield body and/or cross-sectional shapes all might be varied depending on the needs of a particular application and/or implementation. For example, U.S. Pat. No. 6,519,318, previously referenced herein, illustrates additional example embodiments, as do other references referenced and incorporated herein.

Figure 3:
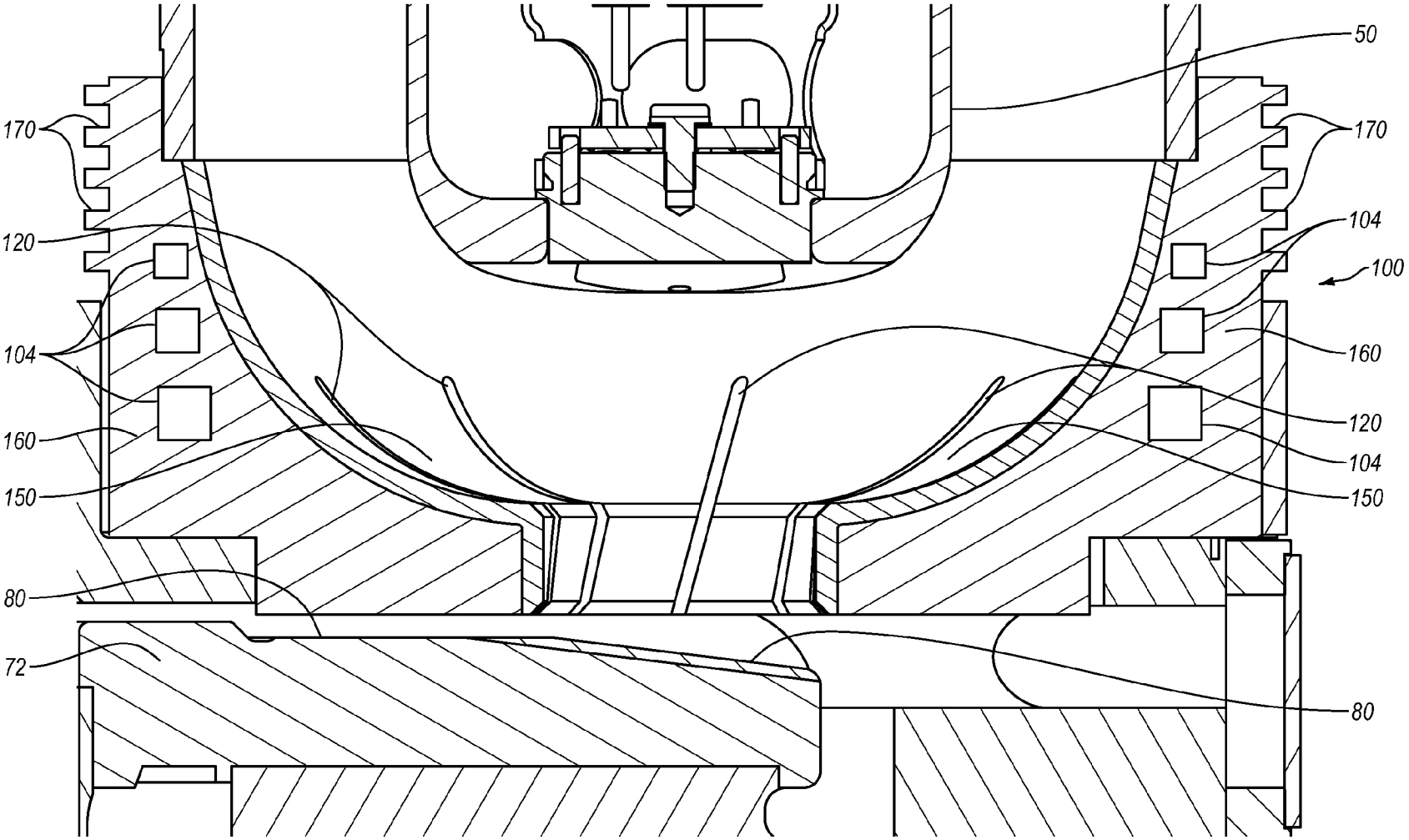
FIG. 3 is an enlarged view of an electron shield disposed between the cathode and the anode of an x-ray tube.

Reference is now made to FIG. 3 which illustrates another embodiment of the electron shield 100 disposed within the x-ray tube 10. FIG. 3 shows an embodiment wherein the electron collection surface 150 is substantially oriented towards the cathode assembly 50 instead of the anode assembly of the previous embodiment. FIG. 3 also illustrates annular cooling fins 170 located on the outer surface of the electron shield 100. The cooling fins 170 further enhance the transfer of heat to the outer surface of the shield 100 and to coolant disposed within the housing 30. Examples and additional details of the use of such cooling fins in the electron shield can be found in U.S. Pat. No. 8,000,450 entitled "Aperture Shield Incorporating Refractory Materials," incorporated by reference above, as well as U.S. Pat. No. 6,519,318 previously referenced. Again, various configurations can be used depending on the needs of a particular implementation.

As noted, backscattered electrons that rebound from the anode 72 are absorbed at the electron collection surface 150. As the electron collection surface 150 absorbs the backscattered electrons the electron collection surface 150 as well as the inner portion 160 of the body (shown in FIG. 2), begin to heat up causing deformation in the electron collection surface 150, particularly in the region near the throat 140 and in the collection surface portion that is adjacent to the aperture 101 due to a higher concentration of rebounding electrons. This deformation can be inelastic, meaning that the electron surface 150 will not return to its original shape but will instead remain in a deformed shape. The gaps provided by slots 120 allow the electron collection surface 150, as well as the inner portion 160 to accommodate the thermal expansion that occurs, thereby reducing thermal stresses.

Figure 4:
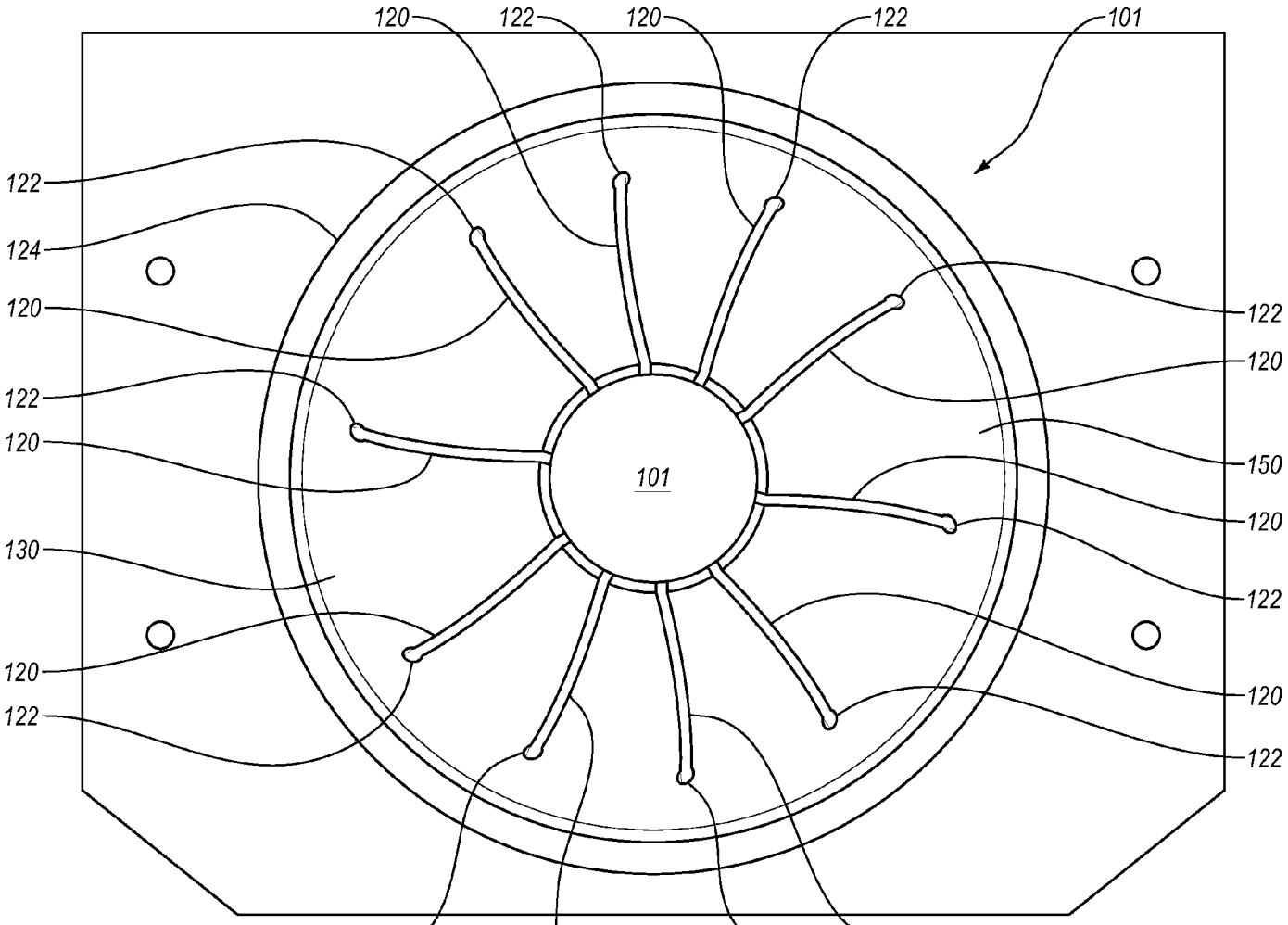
FIG. 4 is a top view of an example electron shield.

FIG. 4 shows a top view of shield 100 that illustrates additional details of slots 120. In this particular embodiment, the slots 120 also include enlarged rounded ends 122 that further reduce the possibility of cracks in the electron collection surface 150 or the joined inner portion 160 past the rounded ends 122 during expansion.

As noted, the slots 120 can also be disposed at an angle offset with respect to the direction of electron travel thereby preventing or reducing the backscattered electrons from passing through the plane of electron travel. The slots can further be disposed beginning on the throat 140 and extending outward into the body that defines the aperture 101. The slots 120 extend into both the electron collection surface 150 and the inner portion 160 shown in FIG. 2.

In one embodiment, a shield 100 is provided with eight equally spaced and radially oriented slots 120, although different numbers and orientations can be used. While a number of geometries can be used depending on the thermal performance, materials, temperatures, etc. that are used, in one embodiment the width of the slots is 0.025 inches. While the slots are shown in the embodiment of FIG. 2 as extending completely through the body 103 of the shield 100 from the electron collection surface 150 past the aperture 101 to a second surface 180, it will be appreciated that this may not be required for all implementations; in certain embodiments the depth of the slot may only extend partially into the body of the shield (for example 10% to 90% of the depth of the shield). Moreover, the width and/or depth may be increased in regions of higher heating—for example regions more proximate to the aperture and/or in the region of the x-ray window. Thus, for example, the depth of the slot may be greater in the region of the aperture and less at the outer periphery of the collection surface.

In other embodiments, the slots 120 can form other arrangements such as beginning on the outer radius 124 and extending inward toward the throat 140, being formed of circles concentric to a radius of the throat 140, and the like. Again, it is appreciated that the slots 120 can have alternate arrangements such that the body of the electron shield 100 that the defines the aperture 101, including the electron collection surface 150 and the inner portion 160 can absorb backscattered electrons while minimizing inelastic deformation. It is also appreciated that the rounded ends 122 can be formed in alternate arrangements to prevent or reduce the cracks in or material discontinuities in the body of the electron shield 100 that forms the aperture 101 and the electron collection surface 150 and inner portion 160 at the ends of the slots 120.

The slots may be formed using any appropriate means, including via a mechanical saw or by way of EDM wire (electro-discharge machining).

The electron shield 100 including slots 120 as described above reduces particulation of electron shield particles where particles of the electron shield may be displaced by impacts with backscattered electrons on other components of the x-ray tube 10 such as the cathode assembly 50. This is so because the slots 120 allow for expansion and contraction of the body of the electron shield 100 that defines the aperture 101. As such, electrons that impinge a portion of the electron shield composed of expansion gaps 120 allow particles of the electron shield 100 to expand but also contract instead of an expansion so great as to displace particles elsewhere in the x-ray tube 10. Thus, shield heating and expansion is provided for which assists in avoiding thermal stress within the shield resulting in particulation of electron shield 100 particles.

The present invention may be embodied in other specific forms without departing from its spirit or essential characteristics.

Thus, all of the described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. In an x-ray tube having a cathode and an anode, an electron shield configured to intercept backscattered electrons from the anode, the electron shield comprising:

a body extending from a first end to a second end, the body defining an aperture and an electron collection surface, the aperture extending from the first end to the second end and configured to allow electrons generated at the cathode to pass to the anode in a direction extending perpendicularly from the cathode; and one or more expansion joints formed in the electron collection surface, the one or more expansion joints extending radially outward from the aperture, wherein no line passing through the one or more expansion joints is parallel to the direction extending perpendicularly from the cathode.

2. The electron shield as defined in claim 1, wherein the expansion joint defines a gap configured to accommodate thermal expansion that occurs in the electron shield during operation of the x-ray tube.

3. The electron shield as defined in claim 2, wherein the expansion joint comprises an elongated slot.

4. The electron shield as defined in claim 3, wherein an end of the slot terminates with a portion having a larger diameter than the width of the slot.

5. The electron shield as defined in claim 3, wherein the slot is formed at an angle offset with respect to the direction of electron travel between the cathode and the anode.

6. The electron shield as defined in claim 1, wherein at least a portion of the aperture and the electron collection surface comprise a refractory material.

7. The electron shield as defined in claim 1, wherein the electron shield further comprises a plurality of cooling fins comprised of a thermally conductive material.

8. The electron shield as defined in claim 1, wherein the body further defines a plurality of fluid channels that surround at least a portion of the aperture and at least a portion of the electron collection surface.

9. An x-ray tube, comprising:

an evacuated enclosure;

a cathode disposed within the evacuated enclosure and configured to emit electrons;

an anode disposed within the evacuated enclosure and positioned with respect to the cathode to receive the electrons emitted by the cathode; and an electron shield interposed between the cathode and anode, the electron shield having a body defining an aperture allowing the electrons to pass from the cathode to the anode, the electron shield including:

an electron collection surface configured to collect electrons that rebound from the anode;

a plurality of expansion joints partially extending into the electron collection surface, wherein no line passing through the expansion joints is parallel to the direction of electron travel between the cathode and the anode; and a plurality of cooling fins composed of a thermally conductive material.

10. The x-ray tube as defined in claim 9, wherein the expansion joints are comprised of slots radially extending from the aperture.

11. The x-ray tube as defined in claim 9, wherein a portion of the electron shield not composed of a refractory material is composed of a thermally conductive material.

12. The x-ray tube as defined in claim 9, wherein at least a portion of the electron collection surface comprises a refractory material.

13. The x-ray tube as defined in claim 9, wherein the electron collection surface is substantially oriented toward the cathode and away from the anode.

14. The x-ray tube as defined in claim 9, wherein:

the body of the electron shield extends from a first end to a second end and defines the aperture extending from the first end to the second end; and the expansion joints begin at the first end and terminate only 10% to 90% of the distance toward the second end.

15. The x-ray tube as defined in claim 9, wherein the body defines a plurality of fluid channels that annularly surround at least a portion of the aperture and at least a portion of the electron collection surface.

16. An electron shield assembly for use in intercepting backscattered electrons from a target surface of an anode, the electron shield assembly comprising:

a body defining an aperture having a throat, the body including:

an electron collection surface comprised of a refractory material;

one or more slots partially extending into the electron collection surface or the throat or both, the one or more slots are formed at an angle offset with respect to the direction of electron travel between a cathode and the anode; and a plurality of fluid channels that annularly surround at least a portion of the throat and at least a portion of the electron collection surface;

wherein no line passing through the one or more slots is parallel to the direction of electron travel through the aperture between the cathode and the anode.

17. The electron shield assembly as defined in claim 13, wherein the electron shield further comprises a plurality of cooling fins composed of a thermally conductive material.

18. The electron shield assembly as defined in claim 16, wherein a depth of each slot is greater in a region of the aperture and less at an outer periphery of the electron collection surface.

19. The electron shield assembly as defined in claim 16, wherein the angle offset prevents backscattered electrons from passing completely through the one or more slots.

* * * * *